US007683868B2

(12) United States Patent
Halfant

(10) Patent No.: US 7,683,868 B2
(45) Date of Patent: Mar. 23, 2010

(54) EXTENDED OVERDRIVE TABLE AND METHODS OF USE THEREOF FOR ENHANCING THE APPEARANCE OF MOTION ON AN LCD PANEL

(75) Inventor: Matthew Halfant, San Jose, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 1139 days.

(21) Appl. No.: 11/060,876

(22) Filed: Feb. 18, 2005

(65) Prior Publication Data

US 2005/0184948 A1 Aug. 25, 2005

Related U.S. Application Data

(60) Provisional application No. 60/546,377, filed on Feb. 20, 2004.

(51) Int. Cl.
*G09G 3/36* (2006.01)

(52) U.S. Cl. ..... 345/89; 345/98

(58) Field of Classification Search ..... 345/89, 345/94, 98

See application file for complete search history.

(56) References Cited

U.S. PATENT DOCUMENTS 6,304,254 B1 * 10/2001 Johnson et al. ..... 345/204
6,876,347 B2 * 4/2005 Tashiro et al. ..... 345/87
7,095,393 B2 * 8/2006 Lee ..... 345/89
7,382,349 B1 * 6/2008 Kuhns ..... 345/102
2003/0006949 A1 * 1/2003 Sekiya et al. ..... 345/87

* cited by examiner

*Primary Examiner*—Chanh Nguyen
*Assistant Examiner*—Ram A Mistry
(74) *Attorney, Agent, or Firm*—Beyer Law Group LLP; Lisa K. Jorgenson

(57) ABSTRACT

An extended overdrive table uses the saturation regions to store useful data that conformably extends the unsaturated region in a natural way. This extended overdrive table reduces the size of any interpolation errors when straddling crossover points to acceptable levels without requiring storing or using any crossover data. In addition, since the saturation regions are used to hold the new data, no additional storage requirements are introduced. The numeric range of the extended table is increased and it is therefore supposed that the bit depth of the table entries is increased, but the table can be resealed to retain the original bit depth with insignificant loss of accuracy. Also, the new data incorporated into the saturation regions allows run time calculation of the pixel attained at the end of the frame time that is needed as the start of the pixel for the next cycle.

19 Claims, 11 Drawing Sheets

Table 4

EXTENDED OVERDRIVE TABLE

| | 0 | 32 | 64 | 96 | 128 | 160 | 192 | 224 | 255 |
|---|---|---|---|---|---|---|---|---|---|
| 0 | 0 | -20 | -38 | -55 | -75 | -100 | -126 | -149 | -167 |
| 32 | 80 | 32 | -6 | -23 | -43 | -68 | -94 | -117 | -135 |
| 64 | 153 | 120 | 64 | 21 | -11 | -36 | -62 | -85 | -103 |
| 96 | 194 | 174 | 141 | 96 | 46 | -4 | -30 | -53 | -71 |
| 128 | 229 | 214 | 195 | 167 | 128 | 72 | 5 | -21 | -39 |
| 160 | 259 | 250 | 236 | 217 | 192 | 160 | 92 | 31 | -7 |
| 192 | 291 | 282 | 275 | 264 | 247 | 226 | 192 | 149 | 94 |
| 224 | 323 | 314 | 307 | 296 | 281 | 270 | 255 | 224 | 195 |
| 255 | 354 | 345 | 338 | 327 | 312 | 301 | 286 | 270 | 255 |

701

Transition from 32 to 192 without overdriving.

Table 3

STANDARD OVERDRIVE TABLE

Voltages for Start and Target Pixel values after one frame time (16.6ms)

| | 0 | 32 | 64 | 96 | 128 | 160 | 192 | 224 | 255 |
|---|---|---|---|---|---|---|---|---|---|
| 0 | 0 | 0 | 0 | 0 | 0 | 0 | 0 | 0 | 0 |
| 32 | 80 | 32 | 0 | 0 | 0 | 0 | 0 | 0 | 0 |
| 64 | 153 | 120 | 64 | 21 | 0 | 0 | 0 | 0 | 0 |
| 96 | 194 | 174 | 141 | 96 | 46 | 0 | 0 | 0 | 0 |
| 128 | 229 | 214 | 195 | 167 | 128 | 72 | 5 | 0 | 0 |
| 160 | 255 | 250 | 236 | 217 | 192 | 160 | 92 | 31 | 0 |
| 192 | 255 | 255 | 255 | 255 | 247 | 226 | 192 | 149 | 94 |
| 224 | 255 | 255 | 255 | 255 | 255 | 255 | 255 | 224 | 195 |
| 255 | 255 | 255 | 255 | 255 | 255 | 255 | 255 | 255 | 255 |

300 indicates saturation region

FIG. 3

Table 4

EXTENDED OVERDRIVE TABLE

| | 0 | 32 | 64 | 96 | 128 | 160 | 192 | 224 | 255 |
|---|---|---|---|---|---|---|---|---|---|
| 0 | 0 | -20 | -38 | -55 | -75 | -100 | -126 | -149 | -167 |
| 32 | 80 | 32 | -6 | -23 | -43 | -68 | -94 | -117 | -135 |
| 64 | 153 | 120 | 64 | 21 | -11 | -36 | -62 | -85 | -103 |
| 96 | 194 | 174 | 141 | 96 | 46 | -4 | -30 | -53 | -71 |
| 128 | 229 | 214 | 195 | 167 | 128 | 72 | 5 | -21 | -39 |
| 160 | 259 | 250 | 236 | 217 | 192 | 160 | 92 | 31 | -7 |
| 192 | 291 | 282 | 275 | 264 | 247 | 226 | 192 | 149 | 94 |
| 224 | 323 | 314 | 307 | 296 | 281 | 270 | 255 | 224 | 195 |
| 255 | 354 | 345 | 338 | 327 | 312 | 301 | 286 | 270 | 255 |

701

FIG. 7

EXTENDED OVERDRIVE TABLE AND METHODS OF USE THEREOF FOR ENHANCING THE APPEARANCE OF MOTION ON AN LCD PANEL

CROSS REFERENCE TO RELATED APPLICATIONS

This patent application takes priority under 35 U.S.C. 119 (e) to U.S. Provisional Patent Application No. 60/546,377 filed on Feb. 20, 2004 entitled "USING AN EXTENDED OVERDRIVE TABLE TO ENHANCE THE APPEARANCE OF MOTION ON AN LCD PANEL" by Halfant that is incorporated by reference in its entirety. This Application is also related to (i) co-pending U.S. patent application Ser. No. 10/985,688 filed Nov. 10, 2004, entitled "DYNAMICAL SYSTEMS APPROACH TO LCD OVERDRIVE" by Halfant and (ii) copending U.S. patent application Ser. No. 11/061,054 filed Feb. 18, 2005 entitled "FACTORED ZERO-DIAGONAL MATRIX FOR ENHANCING THE APPEARANCE OF MOTION ON AN LCD PANEL" by Halfant each of which are incorporated by reference in their entireties for all purposes.

BACKGROUND

1. Field of the Invention

The invention relates to display devices. More specifically, the invention describes a method and apparatus for enhancing the appearance of motion on an LCD panel display.

2. Overview

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after several frames have elapsed, and the resulting display artifacts—"ghost" images of rapidly moving objects—are disconcerting. Ghosting occurs when the response speed of the LCD is not fast enough to keep up with the frame rate. In this case, the transition from one pixel value to another cannot be attained within the desired time frame since LCDs rely on the ability of the liquid crystal to orient itself under the influence of an electric field. Therefore, since the liquid crystal must physically move in order to change intensity, the viscous nature of the liquid crystal material itself contributes to the appearance of ghosting artifacts.

Accordingly, in order for LCDs to display high quality fast motion images, the ghosting problem must be resolved.

SUMMARY OF THE DISCLOSURE

What is provided is an extended overdrive table that uses the saturation regions to store useful data that conformably extends the unsaturated region in a natural way. This extended overdrive table reduces the size of any interpolation errors when straddling crossover points to acceptable levels without requiring storing or using any crossover data. In addition, since the saturation regions are used to hold the new data, no additional storage requirements are introduced. The numeric range of the extended table is increased and it is therefore supposed that the bit depth of the table entries is increased, but the table can be rescaled to retain the original bit depth with insignificant loss of accuracy. Also, the new data incorporated into the saturation regions allows run time calculation of the pixel attained at the end of the frame time that is needed as the start of the pixel for the next cycle.

In a liquid crystal display device having a number of pixels, a method for reducing a response time of the pixels corresponding to a period of time required for a selected pixel at a starting pixel value to reach a desired pixel value is described. The method is carried out by determining an overdrive pixel value based upon an extended overdrive function $G_s(p)$ having an extended LCD saturation region sub-function and an LCD unsaturated region sub-function and applying the overdrive pixel value to the pixel thereby reducing the pixel response time. In a particular embodiment, the $$\text{extended overdrive function } G_s(p) = \begin{cases} p - m(s), & p < m(s) \\ f_s^{-1}(p), & m(s) \le p \le M(s) \\ 255 + (p - M(s)), & p > M(s) \end{cases}$$

wherein m(s) is the minimum pixel value reachable in one frame time starting from s, and M(s) is the maximum pixel value reachable in one frame time starting from s, and wherein where $f_s$ is the one-frame pixel-response function corresponding to a fixed start-pixel, s.

In another embodiment of the invention, computer program product for reducing a response time of the pixels corresponding to a period of time required for a selected pixel at a starting pixel value to reach a target pixel value is disclosed. The computer program product includes computer code for determining an overdrive pixel value based upon an extended overdrive function $G_s$ having an extended LCD saturation region sub-function and an LCD unsaturated region sub-function, computer code for applying the overdrive pixel value to the pixel thereby reducing the pixel response time, and computer readable medium for storing the computer code.

In a liquid crystal display device having a number of pixels, an apparatus for reducing a response time of the pixels corresponding to a period of time required for a selected pixel at a starting pixel value to reach a target pixel value. The apparatus includes a pixel overdrive unit for determining an overdrive pixel value based upon an extended overdrive function $G_s$ having an extended LCD saturation region sub-function and an LCD unsaturated region sub-function and applying a pixel overdrive applying the overdrive pixel value to the pixel thereby reducing the pixel response time.

BRIEF DESCRIPTION OF THE DRAWINGS

FIG. 3 shows an exemplary Standard Overdrive Table (SOT) configured in such a way that a start pixel is given by column j and a target pixel by row i.

FIG. 7 shows an exemplary Extended Overdrive Table (EOT) configured in such a way that a start pixel is given by column j and a target pixel by row i in accordance with an embodiment of the invention.

DETAILED DESCRIPTION OF SELECTED EMBODIMENTS

Figure 1:
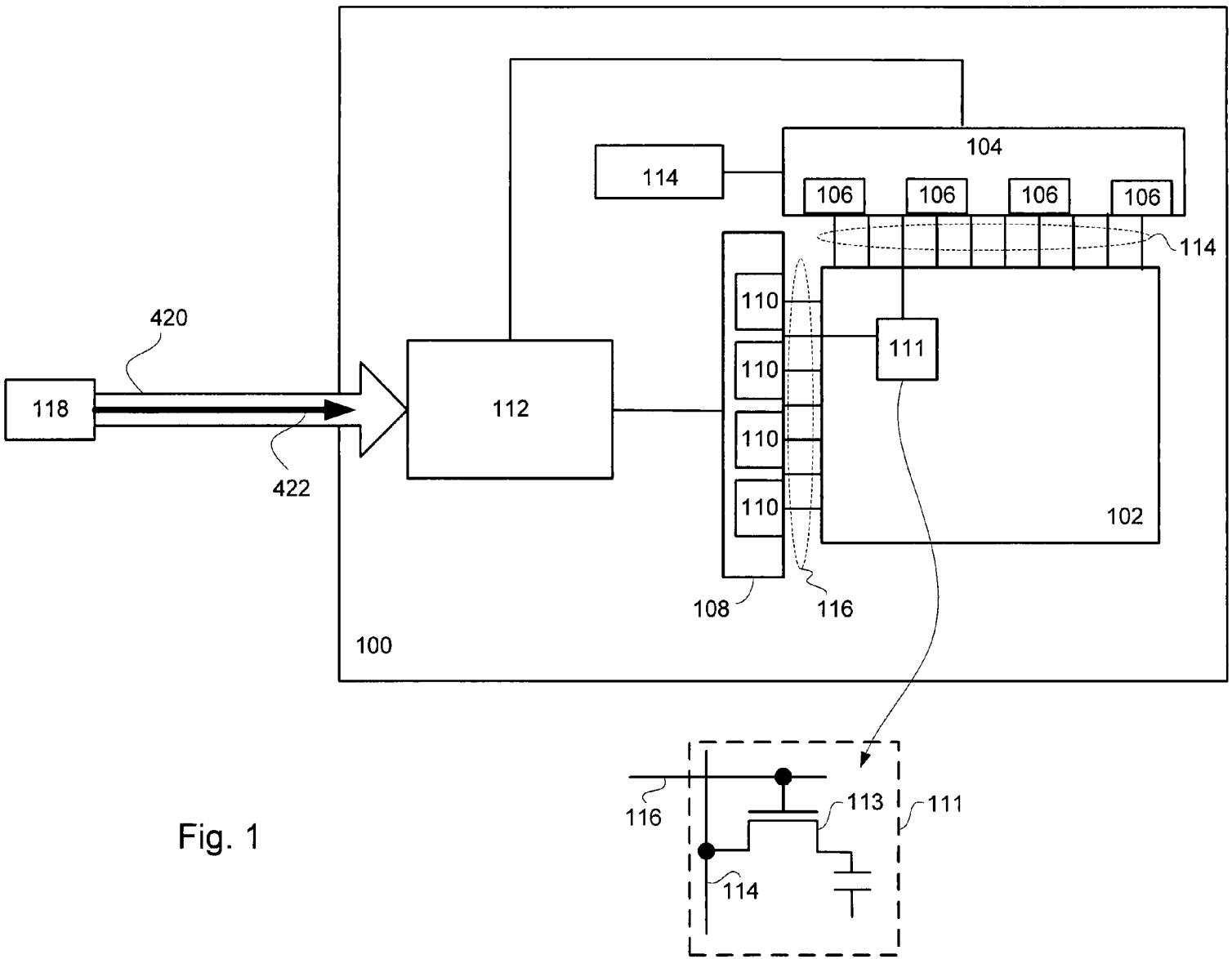
FIG. 1 is a block diagram showing an example of an active matrix liquid crystal display device suitable for use with any embodiment of the invention.

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

An LCD overdrive table is configured as a 9×9 matrix of ROM based lookup data that assists in improving the runtime performance of slow LCD panels. The entries specify start pixel by column and target pixel by row. Pixels not represented by this sparse table are handled at runtime using various interpolation techniques, some of which are described in more detail below. In conventional arrangements, the overdrive table has saturation regions in which the overdrive surface is flattened. The boundaries of these regions are known as crossover curves. Interpolation on a grid square that straddles a crossover curve and which therefore reflects both saturated and unsaturated regions can be inaccurate. In some cases, a detailed calculation using the crossover curves can circumvent this problem at runtime, but the method has been avoided in practice partly because of the additional 2 by 9 table needed to store the crossover data as well as the additional computational resources required to perform the detailed calculations.

An extended overdrive table uses the saturation regions to store useful data that conformably extends the unsaturated region in a natural way. This extended overdrive table reduces the size of any interpolation errors when straddling crossover points to acceptable levels without requiring storing or using any crossover data. In addition, since the saturation regions are used to hold the new data, no additional storage requirements are introduced. The numeric range of the extended table is increased and it is therefore supposed that the bit depth of the table entries is increased, but the table can be rescaled to retain the original bit depth with insignificant loss of accuracy. Also, the new data incorporated into the saturation regions allows run time calculation of the pixel attained at the end of the frame time that is needed as the start of the pixel for the next cycle.

Therefore, what is described herein is a method suitable for implementation in Liquid Crystal Display (LCDs) that reduces a pixel element response time that enables the display of high quality fast motion images thereupon. In the described embodiment, the extended LCD overdrive table is used to provide improved pixel prediction. In a liquid crystal display device having a number of pixels, a method for reducing a response time of the pixels corresponding to a period of time required for a selected pixel at a starting pixel value to reach a target pixel value is described. The method is carried out by determining an overdrive pixel value based upon an extended overdrive function $G_s$ having an extended LCD saturation region sub-function and an LCD unsaturated region sub-function and applying the overdrive pixel value to the pixel thereby reducing the pixel response time. In a particular embodiment, the extended overdrive function $$G_s(p) = \begin{cases} p - m(s), & p < m(s) \\ f_s^{-1}(p), & m(s) \le p \le M(s) \\ 255 + (p - M(s)), & p > M(s) \end{cases}$$

where m(s) is the minimum pixel value reachable in one frame time starting from start-pixel s and M(s) is the maximum pixel value reachable in one frame time starting from start-pixel s, and where $f_s$ is the one-frame pixel-response function corresponding to a fixed start-pixel s.

In order to more fully develop the concepts behind the invention, what follows is a brief description of an active matrix LCD panel suitable for use with any embodiment of the invention. Accordingly, FIG. 1 is a block diagram showing an example of an active matrix liquid crystal display device 100 suitable for use with any embodiment of the invention. As shown in FIG. 1, the liquid crystal display device 100 is formed of a liquid crystal display panel 102, a data driver 104 that includes a number of data latches 106 suitable for storing image data, a gate driver 108 that includes gate driver logic circuits 110, a timing controller unit (also referred to as a TCON) 112. The LCD panel 102 includes a number of picture elements 111 that are arranged in a matrix connected to the data driver 104 by way of a plurality of data bus lines 114 and a plurality of gate bus lines 116. In the described embodiment, these picture elements take the form of a plurality of thin film transistors (TFTs) 113 that are connected between the data bus lines 114 and the gate bus lines 116. During operation, the data driver 104 outputs data signals (display data) to the data bus lines 114 while the gate driver 108 outputs a predetermined scanning signal to the gate bus lines 116 in sequence at timings which are in sync with a horizontal synchronizing signal. In this way, the TFTs 113 are turned ON when the predetermined scanning signal is supplied to the gate bus lines 116 to transmit the data signals, which are supplied to the data bus lines 114 and ultimately to selected ones of the picture elements 111.

Typically, the TCON 112 is connected to a video source 118 (such as a personal computer, TV or other such device) suitably arranged to output a video signal (and, in most cases, an associated audio signal). The video signal can have any number and type of well-known formats, such as composite, serial digital, parallel digital, RGB, or consumer digital video. When the video signal takes the form of an analog video signal, then the video source 118 includes some form of an analog video source such as for example, an analog television, still camera, analog VCR, DVD player, camcorder, laser disk player, TV tuner, set top box (with satellite DSS or cable signal) and the like. In those cases where the video signal is a digital video signal, then the video source 118 includes a digital image source such as for example a digital television (DTV), digital still camera or video camera, and the like. The digital video signal can be any number and type of well known digital formats such as, SMPTE 274M-1995 (1920×1080 resolution, progressive or interlaced scan), SMPTE 296M-1997 (1280×720 resolution, progressive scan), as well as standard 480 progressive scan video.

Figure 2A:
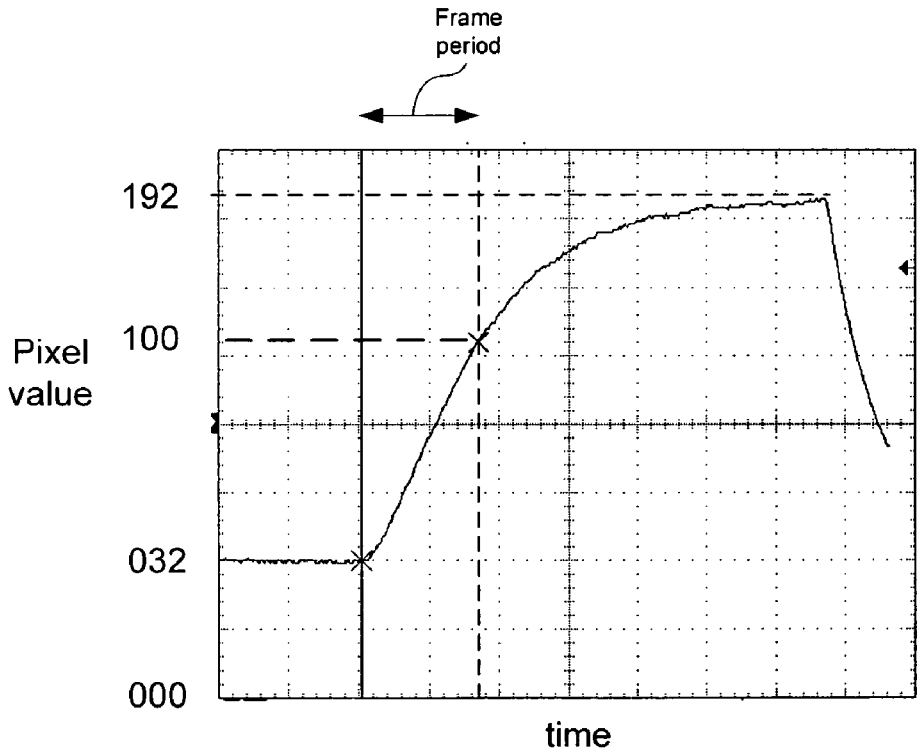
FIG. 2A shows a comparison between an unoverdriven pixel response curve and an overdriven pixel response curve in accordance with an embodiment of the invention.

Deterioration of image quality (such as reduced resolution and blurring) for moving images due to the slower response time of liquid crystal is a common problem for LCD monitors. For example, FIG. 2A shows an oscilloscope plot of the uncompensated transition from pixel level 32 to 192 for a representative pixel. Note that the transition from 32 to 192 does not occur within one frame time and only a pixel value of 100 was achieved instead of the desired target pixel value of 192. In this example, with an individual frame period of 16.6 ms, it takes approximately 4 frames for the voltage level to rise to the equilibrium value represented by the 192 level pixel.

In order to improve the performance of such LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. Accordingly, the hypothetical example from above would be written, in this notation, as $f_{32}(192)=100$ indicating that for a starting value of 32 and a target pixel value of 192, the pixel value at the end of one frame period is expected to be 100.

For slow panels, not all targets can not be reached within a frame time. The functions $$\begin{cases} m(s) = f_s(0) \\ M(s) = f_s(255) \end{cases} \tag{2}$$

give the minimum pixel value m(s) and maximum pixel value M(s) reachable in one frame time as functions of the start pixel value s. It should be noted that these values define maximum-effort curves since they result from applying maximum effort in, respectively, diminishing and increasing directions.

In order to reach a pixel value p that lies in the interval [m(s), M(s)], equation (1) is solved for the argument t that produces pixel value p. The value t thus found is referred to as the overdrive pixel value that will achieve the goal (i.e., pixel value p) in one frame time. If p<m(s), then the overdrive pixel value is taken as having a value of 0, with m(s) being the best-effort result achieved. Likewise, if p>M(s) then the saturating overdrive pixel is taken to be 255, with M(s) being the best-effort result. Thus, for a given start pixel s, overdrive function $g_s$ can be defined by equation 3 as $$g_s(p) = \begin{cases} 0, & p < m(s) \\ f_s^{-1}(p), & m(s) \le p \le M(s) \\ 255, & p > M(s) \end{cases} \tag{3}$$

In this way, the overdrive pixel value is effective in compelling the target pixel to reach its target value in the non-saturation region.

Figure 2B:
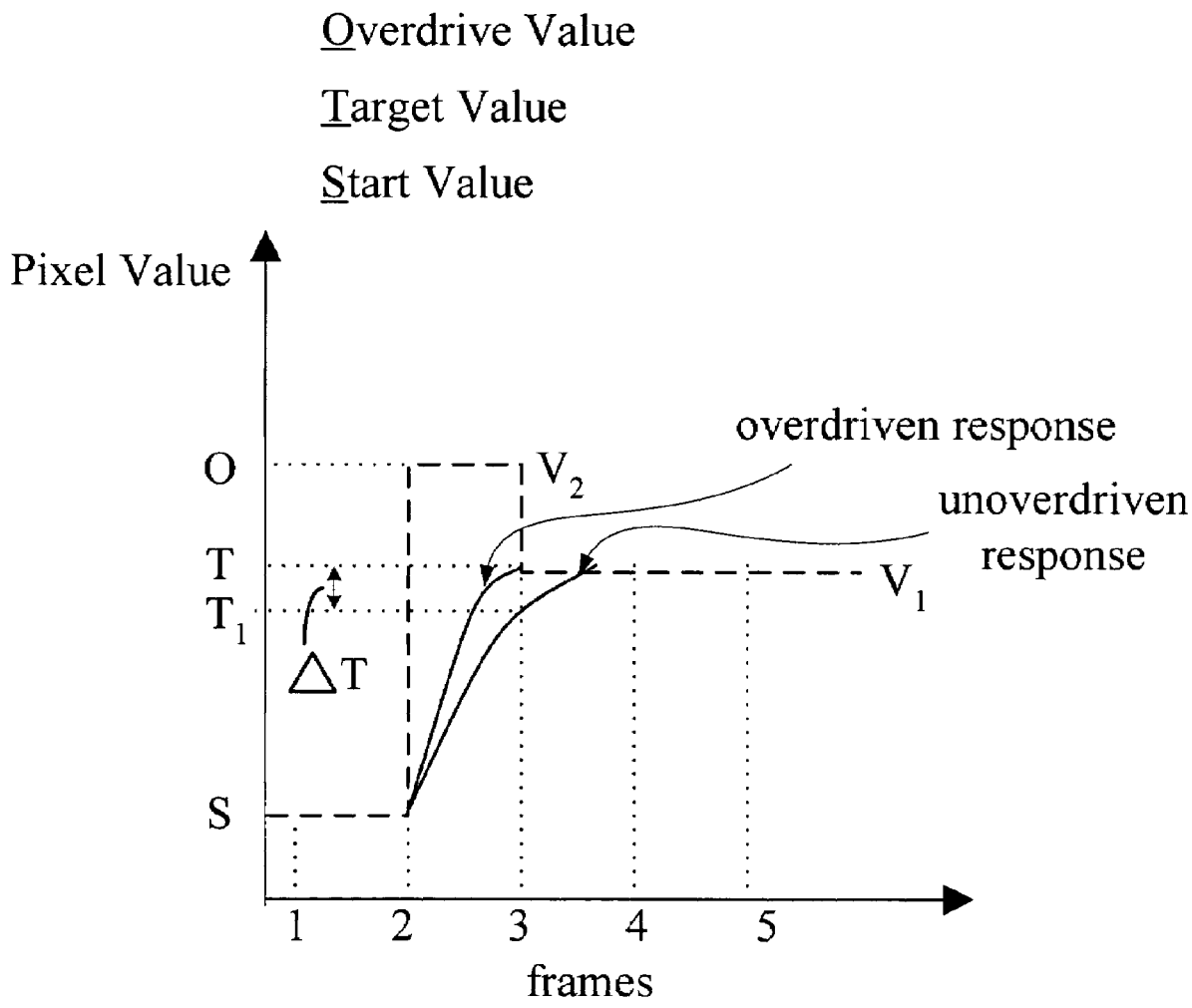
FIG. 2B shows a comparison between an unoverdriven pixel response curve and an overdriven pixel response curve in accordance with an embodiment of the invention.

For example, FIG. 2B shows a comparison between an unoverdriven pixel response curve and an overdriven pixel response curve in accordance with an embodiment of the invention. In the example shown in FIG. 2B, the pixel in question has a start pixel value S at the beginning of a frame 2 and a target pixel value T at the beginning of a next frame 3. However, when the pixel is not overdriven (i.e., a voltage $V_1$ is applied consistent with the target pixel value T), the pixel value achieved $T_1$ falls short of the target pixel value T by a value ΔT resulting in a ghosting artifact in subsequent frames. However, when the pixel is overdriven by applying a voltage $V_2>V_1$ consistent with an overdriven pixel value O, the target pixel value T is reached within the frame period 2 thereby eliminating any ghosting artifacts in subsequent frames.

It should be noted that the overdrive method requires a timely and accurate characterization of the LCD panel's optical response. An accurate model allows the overdrive to more accurately predict the response of a given pixel to an applied pixel value thereby allowing a more accurate selection of overdriven value and predicted pixel values. Since LCD panel response is affected by temperature, a long warm up time was used in order to ensure that the optical responses generated through this procedure were consistent. LCD optical response is temperature dependent. This is the case since the viscosity of the liquid crystal material is also dependent on temperature. The liquid crystals must physically rotate and thus its viscosity determines how quickly this rotation can take place. It is the speed of this rotation that determines the response time of a given LCD panel. In general, as the temperature increases, the viscosity of the liquid crystal decreases, thus decreasing the optical response time.

Using any of a number of non-inertial approaches (i.e., one that ignores pixel velocity) it is possible to create what is referred to as a Full Overdrive Table (FOT) that shows, for each starting pixel and each target pixel, the command pixel that will most-likely cause the target pixel value to be achieved at the end of one frame time. In the described embodiment, the FOT is formed of a lookup table with 256 columns—one for each starting pixel in the range 0 to 255—and likewise 256 rows, one for each possible target. While the FOT solves the runtime problem by simple lookup, it isn't practical to store a table of that size (256×256). However, by sub-sampling the pixel array at every $32^{nd}$ pixel, for example, using a reference sequence:

$$\text{pix}=\{0, 32, 64, 96, 128, 160, 192, 224, 255\} \tag{4}$$

in which the last entry is truncated to 255, a smaller 9×9 array referred to as a Standard Overdrive Table (SOT) is developed that greatly reduces the amount of memory required at runtime. Accordingly, FIG. 3 shows an exemplary Standard Overdrive Table (SOT) 300 configured in such a way that a start pixel is given by column j and a target pixel by row i. It should be noted, however, that the 9×9 SOT 300 that results from "sub-sampling" the FOT on a 32-pixel-wide grid has a number of "missing" rows and columns. It is these "missing" values that are estimated at runtime based on any of a number of well known interpolation schemes. One such interpolation scheme known as bilinear interpolation (discussed in detail below) is used to "read between the lines" of the sparsely populated overdrive table.

Figure 4:
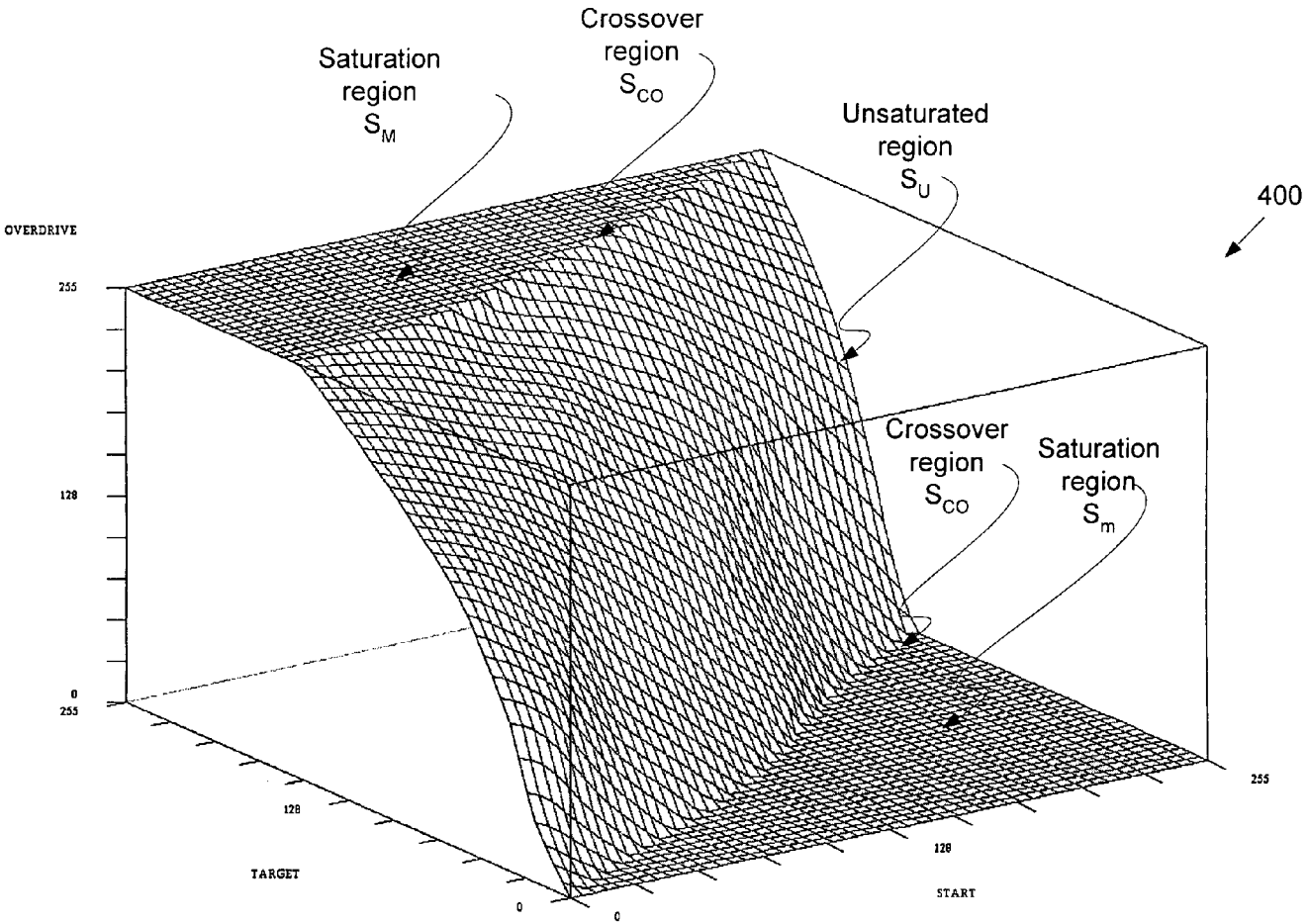
FIG. 4 shows an overdrive table graphically displayed as a three dimensional surface.

As graphically illustrated in FIG. 4 as a surface 400, the overdrive table does not adequately take into consideration the saturation regions ($S_m$ and $S_M$) that are represented by the surface 400 as flat plateau regions $S_m$ and $S_M$. As shown, the regions $S_m$ and $S_M$ form a sharp crease (referred to as cross-over curve $S_{CO}$) with the otherwise smooth unsaturated region $S_U$. As well known in the art, linear interpolation is undermined by high curvature for if a surface is nearly planar, bilinear interpolation works well, however, if the surface warps (i.e., substantially deviates from linearity) then any linear interpolation that includes the warped, or non-linear region, will exhibit substantial interpolation errors. In addition, the large amount of table space dedicated to the saturation regions $S_m$ and $S_M$ (as evidenced by the shaded regions of FIG. 3) wastes a concomitant amount of memory and processing resources since there is essentially little or no information included therein beyond the fact that saturation regions $S_m$ and $S_M$ represent the saturation values 0 and 255.

Figure 5:
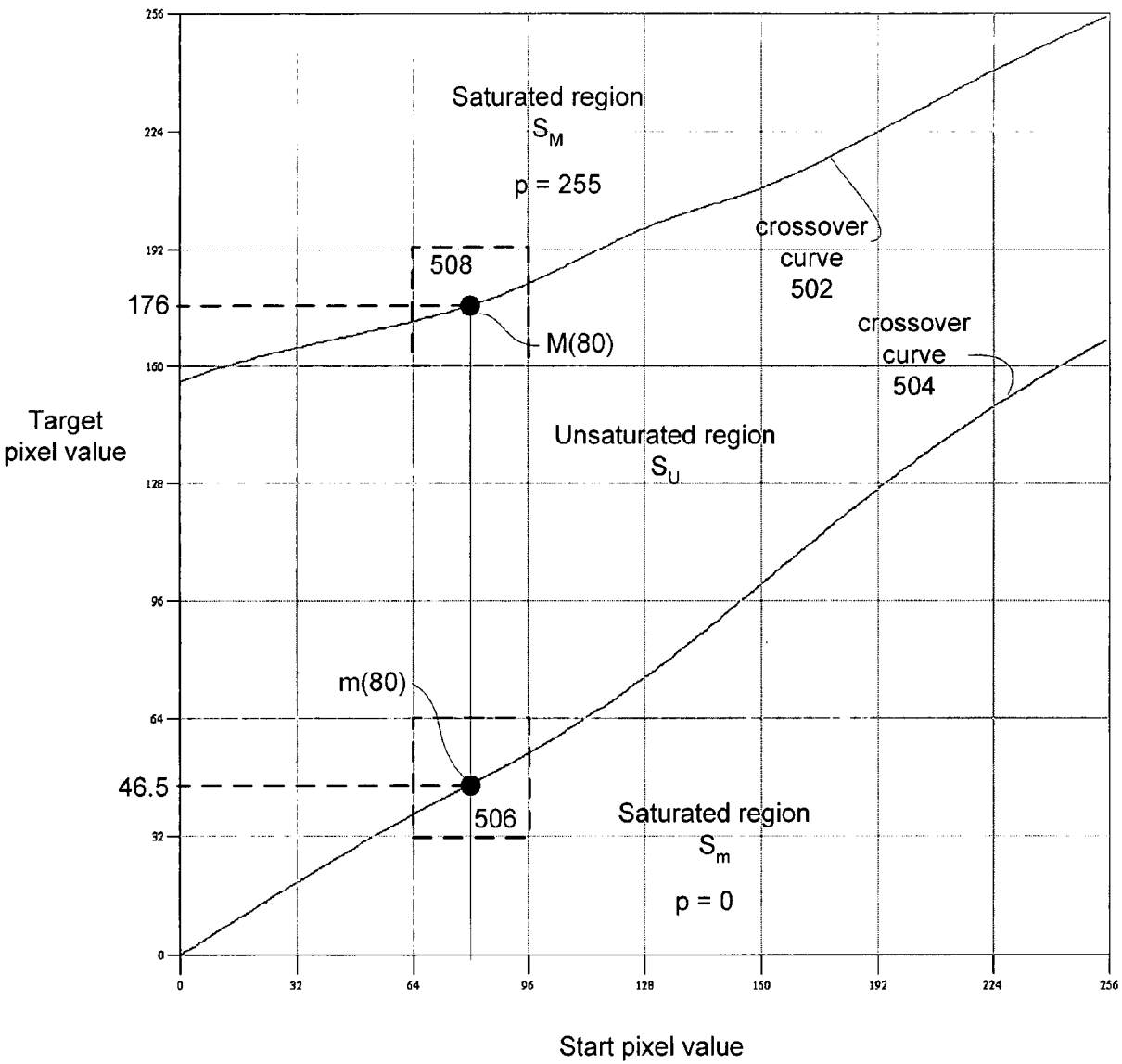
FIG. 5 shows a plan view of the surface shown in FIG. 4 where the upper-left region corresponds to the saturation region $S_M$ with overdrive saturation of 255 and the lower-right region corresponds to the saturation region $S_m$.

FIG. 5 shows a plan view of the surface 400 where the upper-left region corresponds to the saturation region $S_M$ with overdrive saturation of 255 and the lower-right region corresponds to the saturation region $S_m$ with a saturation at 0. The region between the two crossover curves 502 and 504 corresponds to the unsaturated region $S_U$ that rises monotonically between the lower saturated plateau (Sm) and the upper saturated plateau ($S_M$). For a given start and target pixel, interpolation of the standard overdrive table uses values at an associated grid intersections in which the start/target pixel values (s, t) are contained. The grid square that contains the start/target pixel value (s, t) is then bilinearly interpolated at the corner-values. If the grid square is totally within either the saturation plateau regions or in the unsaturated regions, then the interpolation is acceptable. However, if the grid square cuts across either of the crossover curves, then the linear interpolation can be drastically incorrect. For example, any linear interpolation within the grid square 506 (located 3 grid squares over from the left and 2 grid squares up from the bottom) or grid square 508 (located 3 grid squares over from the left and 3 grid squares down from the top) that intersect the cross over curves 502 and 504, respectively, might result in unacceptable interpolation error since both include the crossover curves.

Figure 6:
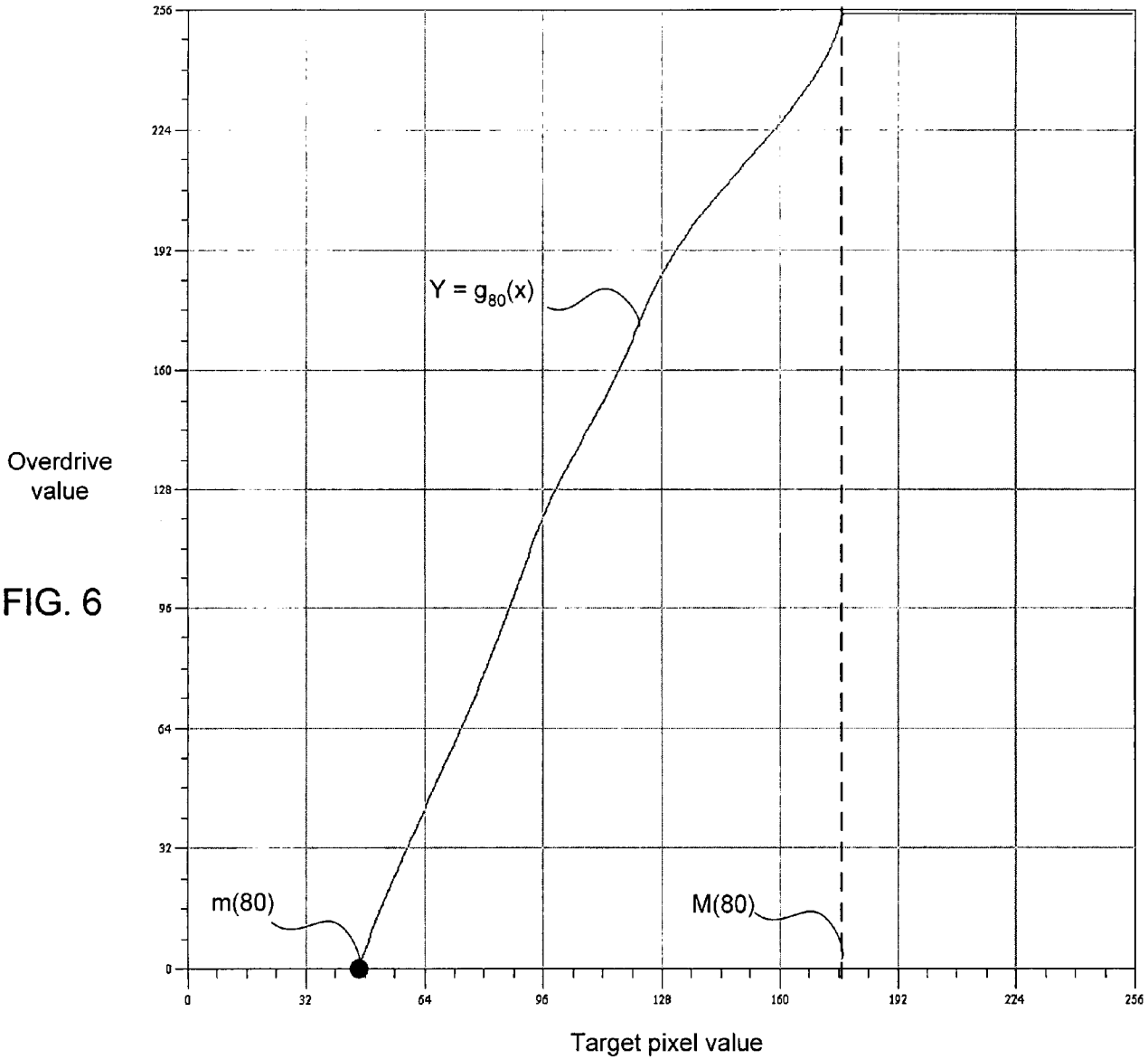
FIG. 6 shows a plot of the overdrive function $y=g_{80}(x)$ based upon FIG. 5.

To better illustrate the problem with interpolating with the aforementioned grid squares (or any such grid square that encompasses any portion of the crossover curves), FIG. 6 shows a plot of the overdrive function $y=g_{80}(x)$ based upon FIG. 5. As seen the plot shown in FIG. 6 is derived by slicing the surface 400 with a vertical plane corresponding to a start pixel value equal to 80 and having a target pixel value go from 0 to 255. In other words, the start pixel value is fixed at 80, the target pixel is displayed on the horizontal axis while the vertical axis shows the overdrive pixel required. Accordingly, using the earlier notation for maximum-effort functions, the unsaturated region extends from m(80)=46 to M(80)=176. Projecting grid square 506 onto FIG. 6, one would expect the worst interpolation error around the middle of the target range from 32 to 64 where the overdrive is just coming out of saturation. In this case, the average must be formed from the 0-saturated value at 32 and the large unsaturated value at 64. Take the exact middle, x=(32+64)/2=48 and substituting into $y=g_{80}(x)$ gives a value of approximately y=5 whereas at runtime the average of values at 32 and 64 is calculated (i.e., (y(32)+y(64))/2) that results in an overdrive value of approximately 21. The error here is about 16, which is large and unacceptable.

Extended Overdrive Table

As discussed above, the LCD standard overdrive table is configured as a 9×9 matrix of ROM based lookup data that assists in improving the runtime performance of slow LCD panels. As shown, the entries specify start pixel by column and target pixel by row whereas pixels not represented by this sparse table are handled at runtime using various interpolation techniques, some of which are described in more detail below. The standard overdrive table has saturation regions in which the overdrive surface is flattened. The boundaries of these regions are known crossover curves. Interpolation on a grid square that straddles a crossover curve and which therefore reflects both saturated and unsaturated regions can be inaccurate.

However, the problem of interpolation in or near the crossover curve $S_{CO}$ can be greatly ameliorated by instituting what is referred to as an extended overdrive table that incorporates information into the saturation regions $S_m$ and $S_M$ that was heretofore ignored. In this way, any interpolation errors are substantially reduced to acceptable levels. Referring back to the sub-sampled overdrive table 3, as mentioned earlier, much of the table space is wasted with saturation data (i.e., values of "0" and or "255").

However, in contrast to the standard overdrive table, an extended overdrive table uses the saturation regions to store useful data that conformably extends the unsaturated region in a natural way. This extended overdrive table reduces the size of any interpolation errors when straddling crossover points to acceptable levels without using any crossover data. In addition, since the saturation regions are used to hold the new data, no additional storage requirements are introduced. The numeric range of the extended table is increased and it is therefore supposed that the bit depth of the table entries is increased, but the table can be rescaled to retain the original bit depth with insignificant loss of accuracy. Also, the new data incorporated into the saturation regions allows run time calculation of the pixel attained at the end of the frame time. The standard overdrive table does not allow this calculation which is needed as the start of the pixel for the next cycle.

Accordingly, the overdrive function is given as equation 5.

$$g_s(p) = \begin{cases} 0, & p < m(s) \\ f_s^{-1}(p), & m(s) \le p \le M(s) \\ 255, & p > M(s) \end{cases} \tag{5}$$

Figure 8:
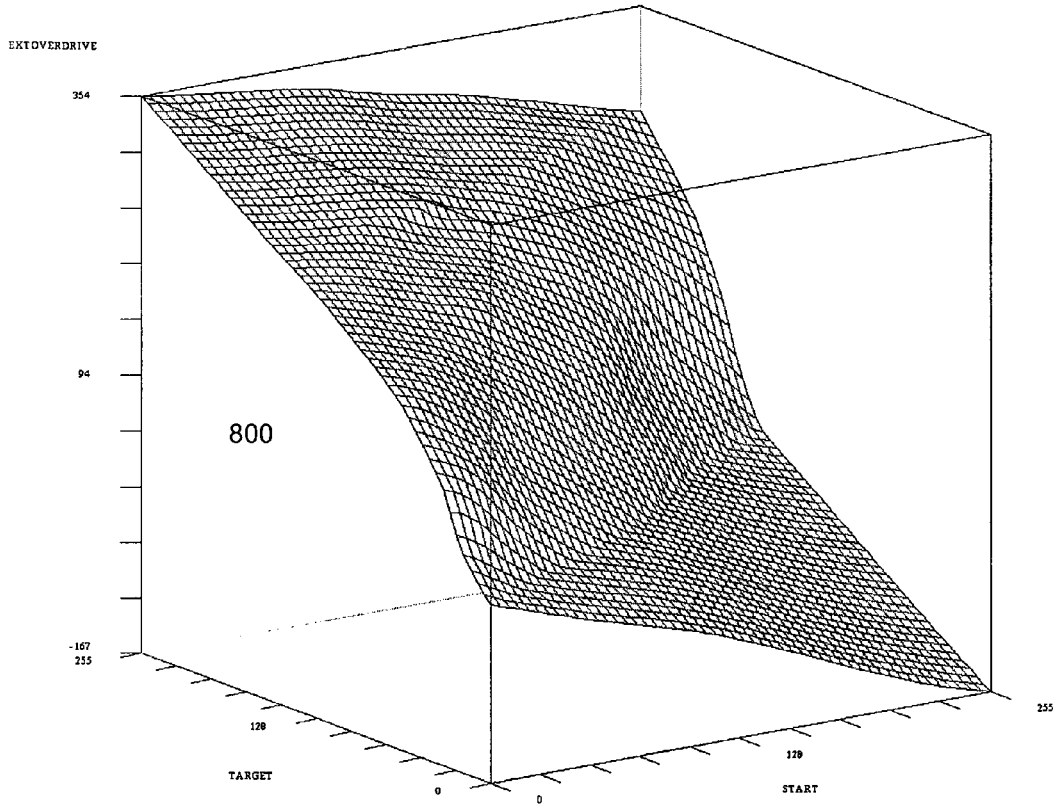
FIG. 8 shows an extended overdrive table graphically displayed as a three dimensional surface in accordance with an embodiment of the invention.
Figure 9:
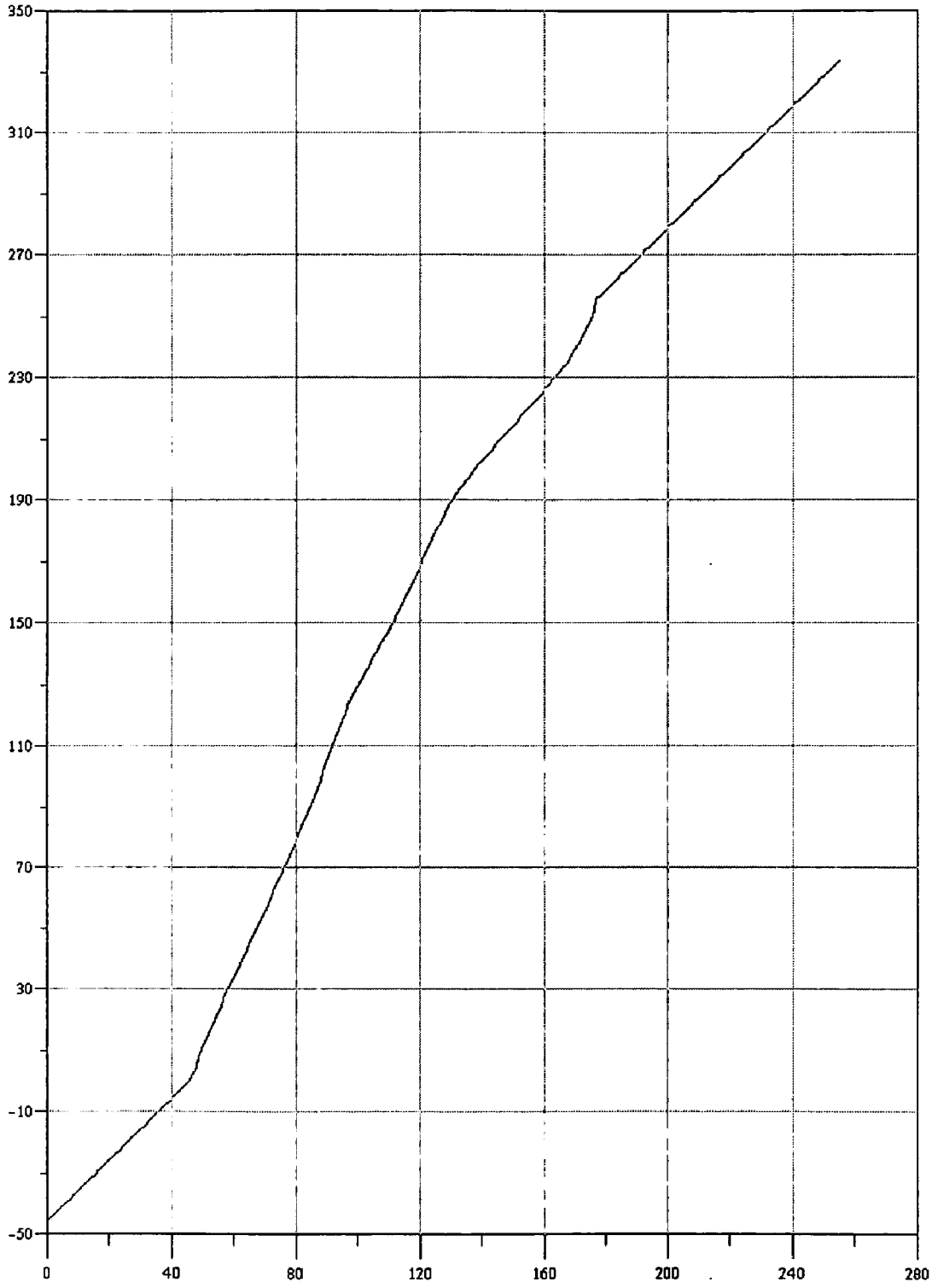
FIG. 9 shows a plot of the overdrive function $y=G_{80}(x)$ based upon FIG. 8.

In order to arrive at the extended overdrive table, the function is altered in the saturation regions, first to incorporate some useful information, and second to extend the unsaturated region in a fashion that will reduce the interpolation errors. For example, consider the case of a target pixel p>M(s) for which the overdrive value is in saturation at $g_s(p)=255$. The difference δ(p)=p−M(s) is a measure of the shortfall from the target pixel p; it is referred to as the deficit δ(p). There is no deficit (δ=0) in the unsaturated region, but the deficit becomes positive and grows by one pixel for each pixel further that the target p proceeds past the maximum M(s). In the Extended Overdrive Table (EOT), the deficit is added to the saturation value of 255. At the low end the deficit is negative: there the deficit δ(p)=p−m(s) to again reflect the idea that the deficit is the difference between the target pixel value and the achieved pixel value, only here the target p is smaller than the minimum achieved. Again, the deficit is added to the saturation value, which in this case is 0. Thus, the Extended Overdrive function for fixed start pixel s is defined by $$G_s(p) = \begin{cases} p - m(s), & p < m(s) \\ f_s^{-1}(p), & m(s) \le p \le M(s) \\ 255 + (p - M(s)), & p > M(s) \end{cases} \tag{6}$$

an example of which is shown in FIG. 7 showing a Table 4 corresponding to an extended overdrive surface 800 shown in FIG. 8 that illustrates how the unsaturated region surface slope is better matched at the crossover curves adjoining the upper saturation region $S_M$ and the lower saturation region $S_m$. To better illustrate the improved match between the saturated region $S_m$ and $S_M$ and the unsaturated region $S_u$, FIG. 9 shows the extended overdrive curve $y=G_{80}(x)$. It should be noted that in contrast to the SOT, the extended overdrive curve has a non-zero slope in either saturation regions $S_m$ and $S_M$ due to the fact that information heretofore not included is incorporated into the EOT values for the saturation regions.

As an example, assume one wanted to go from a start pixel of 100 to a target pixel of 200. The relevant sub matrix has its upper left corner at grid lines corresponding to start pixel=96 and target pixel equal 192, and is displayable as

| | |
|---|---|
| 264 | 247 |
| 296 | 281 |

which is the sub matrix 701 of the EOT 700 shown in FIG. 7. As shown, every element except the upper right one is in the saturation region, so one would expect to avoid saturation only if we're interpolating close to that corner (start=128, target=192). The answer can be worked as $$y=269.9375.$$

Since this is greater than 255, it means the pixel is in saturation, and the overdrive pixel is simply 255. But the answer indicates that the excess over 255 is equal to the deficit, or shortfall, between the target and the pixel value actually attained. This deficit is just $$\delta=y-255$$

$$\delta=14.9375$$

and therefore the pixel attained is $$\text{pixel value}=200-\delta$$

$$\text{pixel value}=185.0625$$

Of course any target pixel in the high saturation region would reach this same value, it being the maximum attainable target starting from 100. That is the information contained in the maximum-effort curves, and these curves are implicitly present in the EOT. This can be seen as follows: from equation (6)

$$G_s(p)=255+(p-M(s)),\ p>M(s) \tag{7}$$

and in particular, when p=255 then equation (7) reduces to:

$$G_s(255)=510-M(s). \tag{8}$$

This is the bottom row of the EOT whereas the lower crossover curve appears as the top row of the EOT with signs reversed, i.e., $$G_s(p)=p-m(s),\ p<m(s) \tag{9}$$

and, in particular when p=0, $$G_s(0)=-m(s) \tag{10}$$

Bilinear Interpolation Scheme

In order to calculate pixel values that lie between pixel values actually calculated, a number of interpolation schemes are used. In the described embodiment, these interpolation schemes include both bilinear interpolation and surface triangulation. Bilinear interpolation is a two-dimensional interpolation process where the sample value is obtained through successive linear interpolations using the value of its four closest neighbors. Note that each interpolation is linear as shown in FIG. 18. Suppose that point G is the value to be calculated. Three separate linear interpolations are used in order to calculate G. The first interpolation is performed between points A and B to determine the value of the surface at point E. The second interpolation is performed between points C and D to determine the value of the surface at point F. Using points E and F, the objective of calculating point G can be obtained through linear interpolation.

The equation for calculating the values at E, F, and G are as follows:

$$E=A+(B-A)\frac{x}{a},\ F=C+(D-C)\frac{x}{a},\ G=E+(F-E)\frac{y}{a}$$

This set of equations can be simplified to:

$$G=\left(1-\frac{y}{a}\right)\left(A\left(1-\frac{x}{a}\right)+B\frac{x}{a}\right)+\frac{y}{a}\left(C\left(1-\frac{x}{a}\right)+D\frac{x}{a}\right)$$

Figure 10:
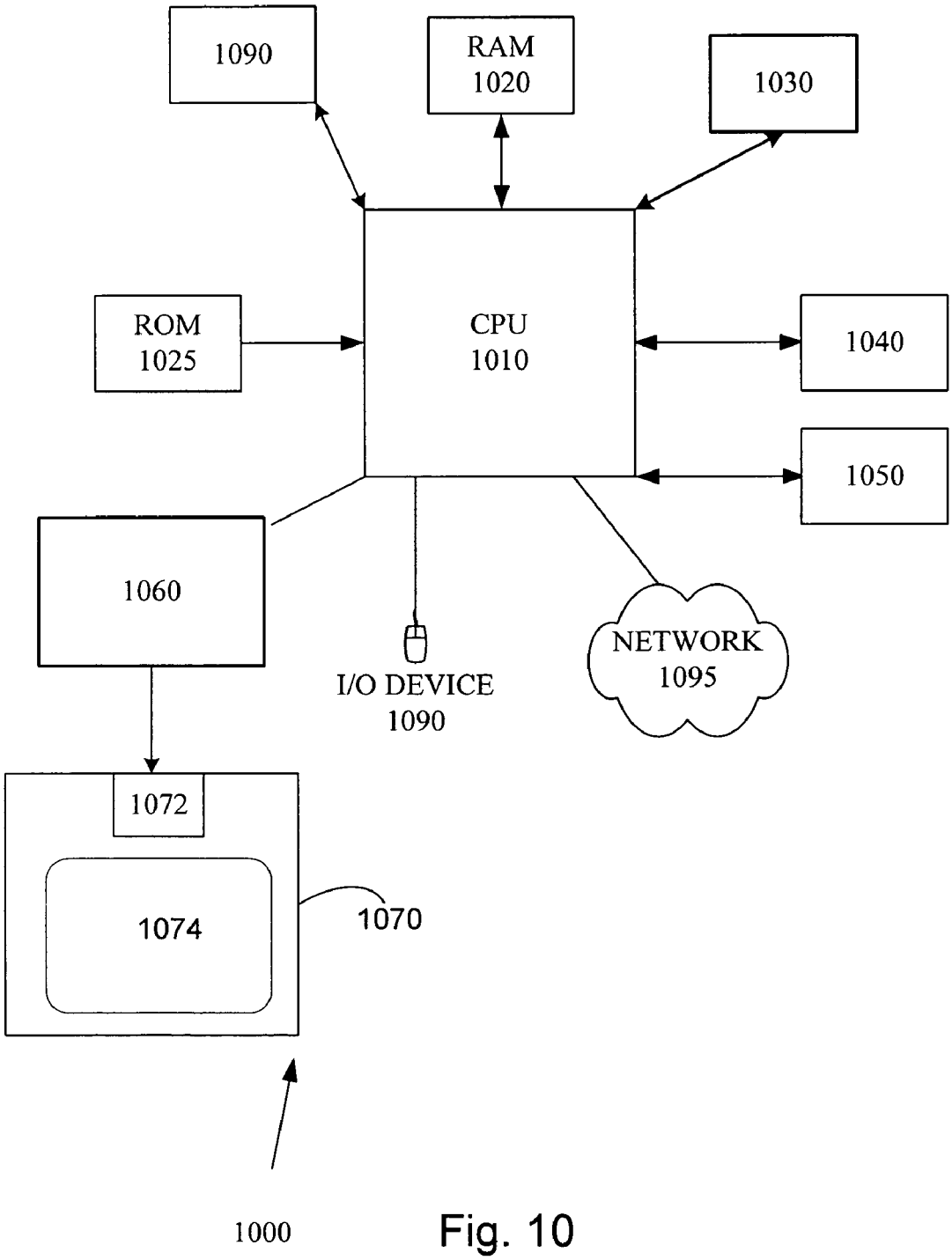
FIG. 10 illustrates a system employed to implement the invention.

FIG. 10 illustrates a system 1000 employed to implement the invention. Computer system 1000 is only an example of a graphics system in which the present invention can be implemented. System 1000 includes central processing unit (CPU) 1010, random access memory (RAM) 1020, read only memory (ROM) 1025, one or more peripherals 1030, graphics controller 460, primary storage devices 1040 and 1050, and digital display unit 1070. CPUs 1010 are also coupled to one or more input/output devices 1090 that may include, but are not limited to, devices such as, track balls, mice, keyboards, microphones, touch-sensitive displays, transducer card readers, magnetic or paper tape readers, tablets, styluses, voice or handwriting recognizers, or other well-known input devices such as, of course, other computers. Graphics controller 1060 generates image data and a corresponding reference signal, and provides both to digital display unit 1070. The image data can be generated, for example, based on pixel data received from CPU 1010 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats. For example, image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

The invention claimed is:

1. In a liquid crystal display device having a number of pixels, a method for reducing a response time of the pixels corresponding to a period of time required for a selected pixel at a starting pixel value (s) to reach a target pixel value (p) by applying only an overdrive pixel value, comprising:

determining an overdrive pixel value based upon an extended overdrive function $$G_s(p) = \begin{cases} p - m(s), & p < m(s) \\ f_s^{-1}(p), & m(s) \le p \le M(s) \\ 255 + (p - M(s)), & p > M(s) \end{cases}$$

that dynamically provides the overdrive pixel value and which includes an extended LCD saturation region sub-function and an LCD unsaturated region sub-function, wherein $G_s(p)$ provides the overdrive pixel value, wherein in(s) is the minimum pixel value reachable in one frame time starting at s and M(s) is the maximum pixel value reachable in one frame time starting at s, wherein $f_s$ is the one-frame pixel-response function corresponding to a fixed start-pixel s, wherein the extended LCD saturation region sub-function includes the functions $G_s(p)=p-m(s)$ and $G_s(p)=255+(p-M(s))$ over the ranges $p<m(s)$ and $p>M(s)$, respectively; and applying only the overdrive pixel value to the pixel in order to reach the target pixel value (p), thereby reducing the pixel response time.

2. A method as recited in claim 1, wherein the LCD unsaturated region sub-function includes the function $G_s(p)=f_s^{-1}(p)$ over the associated range $m(s)\leqq p\leqq M(s)$.

3. A method as recited in claim 2, wherein when the staffing pixel value (s) and the target pixel value (p) are each in the LCD unsaturated region, then the target pixel value p is reached within one frame period such that a deficit $\delta(p)$ corresponding to a difference between the target pixel value and a pixel value achieved in one frame time is substantially zero.

4. A method as recited in claim 2, wherein when the target pixel value p is greater than the maximum pixel value reachable in one frame time M(s) then the deficit $\delta(p)$ becomes positive and grows by one pixel for each pixel further that the target p proceeds past the maximum pixel value reachable in one frame time M(s) wherein the deficit $\delta(p)$ is added to a first saturation value.

5. A method as recited in claim 4, wherein the first saturation value is 255.

6. A method as recited in claim 2, wherein when the target pixel value p is less than the minimum pixel value reachable in one frame time m(s) then the deficit $\delta(p)=p-m(s)$ wherein the deficit $\delta(p)$ is added to a second saturation value.

7. A method as recited in claim 6, wherein the second saturation value is 0.

8. The method as recited in claim 1, wherein the determining an overdrive pixel value is additionally based upon an associated extended overdrive table.

9. Computer program product stored in one or more tangible computer-readable media for reducing a response time of pixels corresponding to a period of time required for a selected pixel at a starting pixel value (s) to reach a target pixel value (p) by applying only an overdrive pixel value, comprising:

computer code for determining an overdrive pixel value based upon an extended $$\text{overdrive function } G_s(p) = \begin{cases} p - m(s), & p < m(s) \\ f_s^{-1}(p), & m(s) \le p \le M(s) \\ 255 + (p - M(s)), & p > M(s) \end{cases}$$

that dynamically provides the overdrive pixel value and which includes an extended LCD saturation region sub-function and an LCD unsaturated region sub-function, wherein $G_s(p)$ provides the overdrive pixel value, wherein m(s) is the minimum pixel value reachable in one frame time starting at s and M(s) is the maximum pixel value reachable in one frame time starting at s, wherein $f_s$ is the one-frame pixel-response function corresponding to a fixed start-pixel s, wherein the extended LCD saturation region sub-function includes the functions $G_s(p)=p-m(s)$ and $G_s(p)=255+(p-M(s))$ over the ranges $p<m(s)$ and $p>M(s)$, respectively; and computer code for applying only the overdrive pixel in order to reach the target pixel value (p) value to the pixel thereby reducing the pixel response time.

10. Computer program product as recited in claim 9, wherein the LCD unsaturated region sub-function includes the function $G_s(p)=f_s^{-1}(p)$ over the associated range $m(s)\leqq p\leqq M(s)$.

11. Computer program product as recited in claim 10, wherein when the starting pixel value (s) and the target pixel value (p) are each in the LCD unsaturated region, then the target pixel value p is reached within one frame period such that a deficit $\delta$ corresponding to a difference between the target pixel value and a pixel value achieved in one frame time is substantially zero.

12. Computer program product as recited in claim 11, wherein when the target pixel value is greater than the maximum pixel value reachable in one frame time M(s) then the deficit becomes positive and grows by one pixel for each pixel further that the target p proceeds past the maximum wherein the deficit $\delta(p)$ is added to a first saturation value.

13. Computer program product as recited in claim 12, wherein the first saturation value is 255.

14. Computer program product as recited in claim 13, wherein when the target pixel value p is less than the minimum pixel value reachable in one frame time m(s) then the deficit $\delta(p)=p-m(s)$ wherein the deficit $\delta(p)$ is added to a second saturation value.

15. Computer program product as recited in claim 14, wherein the second saturation value is 0.

16. The computer program product as recited in claim 9, wherein the determining an overdrive pixel value is additionally based upon an associated extended overdrive table.

17. In a liquid crystal display device having a number of pixels, an apparatus for reducing a response time of the pixels corresponding to a period of time required for a selected pixel at a starting pixel value (s) to reach a target pixel value (p) by applying only an overdrive pixel value, comprising:

a pixel overdrive unit for determining an overdrive pixel value based upon an extended $$\text{overdrive function } G_s(p) = \begin{cases} p - m(s), & p < m(s) \\ f_s^{-1}(p), & m(s) \le p \le M(s) \\ 255 + (p - M(s)), & p > M(s) \end{cases}$$

that dynamically provides the overdrive pixel value and which includes an extended LCD saturation region sub-function and an LCD unsaturated region sub-function and applying the overdrive pixel value to the pixel thereby reducing the pixel response time, wherein $G_s(p)$ provides the overdrive pixel value, wherein m(s) is the minimum pixel value reachable in one frame time starting at s and M(s) is the maximum pixel value reachable in one frame time starting at s, wherein $f_s$ is the one-frame pixel-response function corresponding to a fixed start-pixel s, wherein the extended LCD saturation region sub-function includes the functions $G_s(p)=p-m(s)$, and $G_s(p)=255+(p-M(s))$ over the ranges $p<m(s)$ and $p>M(s)$, respectively applying only the overdrive pixel value to the pixel in order to reach the target pixel value (p), thereby reducing the pixel response time.

18. The apparatus as recited in claim 17, wherein the LCD unsaturated region sub-function includes the function $G_s(p)=f_s^{-1}(p)$ over the associated range $m(s)\leqq p\leqq M(s)$.

19. The apparatus as recited in claim 18, wherein the determining an overdrive pixel value is additionally based upon an associated extended overdrive table.

* * * * *